US005215573A

United States Patent [19]

Brunner

[11] Patent Number: 5,215,573

[45] Date of Patent: Jun. 1, 1993

[54] TREATMENT OF MELTS IN A LADLE AND APPARATUS FOR SUCH TREATMENT

[76] Inventor: Mikael Brunner, Tvärvägen 1, S-183 30 Täby, Sweden

[21] Appl. No.: 781,156

[22] PCT Filed: May 2, 1990

[86] PCT No.: PCT/SE90/00286

§ 371 Date: Nov. 1, 1991

§ 102(e) Date: Nov. 1, 1991

[87] PCT Pub. No.: WO90/13382

PCT Pub. Date: Nov. 15, 1990

[30] Foreign Application Priority Data

May 2, 1989 [SE] Sweden ..... 8901585

[51] Int. Cl.[5] ..... C22B 9/05

[52] U.S. Cl. ..... 75/708; 266/158

[58] Field of Search ..... 266/158; 75/708

[56] References Cited

U.S. PATENT DOCUMENTS

| | | | |
|---|---|---|---|
| 3,060,015 | 10/1962 | Spolders et al. . | |
| 3,320,053 | 5/1967 | Lehman . | |
| 3,598,383 | 8/1971 | Moore . | |
| 4,309,025 | 1/1982 | Meichsner . | |
| 4,718,646 | 1/1988 | Jonsson et al. . | |
| 4,720,837 | 1/1988 | Kanada | 266/158 |
| 4,740,242 | 4/1988 | Nakamura . | |
| 4,944,799 | 7/1990 | Tanabe et al. | 75/544 |

FOREIGN PATENT DOCUMENTS 114376 12/1983 European Pat. Off. .

OTHER PUBLICATIONS

Patent Abstracts of Japan vol. 7, No. 147, C173 Abstract JP 58-58220 pub. 1983.

Jonsson, Lars et al "Gasteknik; Gjuterier" 1984 Eskilstuna Offset Sundbyberg.

*Primary Examiner*—Melvyn J. Andrews

*Attorney, Agent, or Firm*—Pollock, Vande Sande & Priddy

[57] ABSTRACT

A ladle arrangement intended for use when treating a metal melt, in which gas or gas/powder mixture is delivered to the melt (2) which substantially fills the ladle (1), and departing gases are extracted by suction through a hood mounted above the ladle. The inventive ladle arrangement is effective to permit the gas or gas/powder mixture to be delivered to the melt in a large volumetric flow, wherewith the melt will bubble and splash vigorously. For the purpose of restricting the effects of these melt splashes to a defined space above the melt (2), the gas extraction hood has the form of a lid (7) which is intended to substantially seal against the upper edge of the ladle (1). The lid is configured so that the volume (6) defined by the lid above the melt will correspond to a substantial part, preferably at least half, of the volume of the melt (2) in the ladle (1). The side surfaces of the lid (7) define splash droplet pathway operative to return the droplets to the melt in the ladle. The invention also relates to a method of treating a metal melt in a ladle.

10 Claims, 1 Drawing Sheet

TREATMENT OF MELTS IN A LADLE AND APPARATUS FOR SUCH TREATMENT

The present invention relates to a method of treating a metal melt in a ladle, in which a gas or gas/powder mixture is introduced to the melt in a substantially completely filled ladle and departing gas is removed by suction through a hood mounted above the ladle. The invention also relates to a ladle arrangement for use in such treatment of a metal melt.

Steel is produced from pig iron, scrap or sponge iron starting materials which are melted and decarburized in different types of furnaces, converters or like apparatus. The metal melt is handled and transported with the aid of ladles having a volumetric capacity which is adapted to the process concerned. The ladles have the form of upwardly open vessels.

Steel could be manufactured more effectively if the time that the melt spends in a ladle could be utilized to effect some part of the treatment to which the melt shall be subjected. For instance, this would decrease the time spent by the melt in a converter. In modern times, the term ladle metallurgy includes such efforts to utilize the ladle as a treatment station in steel manufacturing processes.

Examples of those processes to which the melt can be subjected in a ladle are the various purifying processes effected by introducing additives into the melt and agitating the melt with the aid of gases, and the introduction of pulverous alloying substances and slag formers, which is often effected in combination with the supply of a gas so as to achieve effective admixture of the alloying substances with the melt. Since the ladle is relatively deep, effective admixture of material with the melt with the aid of gas can be achieved when the additive material and the gas are introduced into the ladle at a location adjacent the bottom thereof.

When applying ladle metallurgy, one problem is that only a very restricted gas flow can be delivered to a full ladle, since otherwise splash-over becomes unacceptable, or the melt "boils over" the ladle rim. The volumetric capacity of the ladle is namely so adapted to the process concerned as to be substantially totally filled with melt. It is therewith impossible to reduce the volume of melt in the ladle, for practical and economic reasons.

By way of comparison, it can be mentioned that in those processes in which gas is delivered to converters, the converters are filled only with a relatively small volume of melt, therewith enabling the specific gas flow to be maintained at a very high level. It can be mentioned as an example that in the case of the process known under the acronym BOF (Basic Oxygen Furnace), the converter is normally filled with melt solely to 10% of its volumetric capacity, therewith enabling a specific gas flow of 4.0 $Nm^3$/ton/min to be used. When manufacturing stainless steel in accordance with the AOD-process (Argon Oxygen Decarburization), the converter is filled to 50% of its volumetric capacity, permitting a specific gas flow of 1.0 $Nm^3$/ton/min to be used. On the other hand, in conventional ladle metallurgy, the ladle is normally filled to about 90% of its volumetric capacity, wherein a specific gas flow of only 0.002 $Nm^3$/ton/min can be used. It is quite probable that this low gas flow is the reason why, for instance, the hydrogen content of the melt cannot be decreased to any appreciable extent when treating the melt with an inert gas.

Accordingly, the prime object of the present invention is to solve the problem of enabling metal melts to be treated effectively in ladles of conventional design, by delivering large specific gas flows to such ladles without the melt bubbling over or splashing from the ladle.

The inventive solution is based on the realization that the aforesaid object can be achieved by providing above the ladle a closed splash chamber of sufficient volume to permit "boiling over" and splashing to take place without detriment when introducing large quantities of gas into the melt. The splash chamber must also be so configured that molten metal which splashes from the ladle is returned effectively to the melt in said ladle.

The aforesaid objects are achieved in accordance with the present invention with a method of the kind defined in the introductory paragraph of the description which is characterized by introducing the gas or gas/powder mixture into the melt in a large volumetric flow, therewith causing the melt to bubble and splash vigorously; by limiting the effects of such bubbling and splashing to a defined space above the melt; by configuring the gas suction hood in the form of a lid which is placed substantially sealingly against the upper edge of the ladle; by giving the lid a configuration such that the volume of the space defined above the melt by means of the lid corresponds to a substantial part of the melt volume in the ladle, preferably at least half of said volume; and by returning melt which has splashed-up on the inside of the lid to the melt in the ladle with the aid of the sides of said lid. The melt splashes are preferably returned to the ladle by guiding said melt splashes along the sides of the lid in pathways which terminate radially inwards of the upper defining edge of the ladle. The inner surfaces of the lid are preferably formed from a refractory material or some other heat-resistant construction which is capable of withstanding the het given-off by the upwardly splashing or "overboiling" melt.

The inventive method thus enables a metal melt to be treated highly effectively during that time the melt remains in the ladle, since it is possible to supply large quantities of gas over short time periods at a relatively deep depth in the melt. In this way, there is achieved maximum admixture of gas and optionally powder with the melt in combination with effected agitation of the melt and long gas-residence times in said melt.

In the case of one ladle embodiment for use when carrying out the method, the lid has a frustoconical configuration and the lid is intended to support against the upper defining edge of the ladle along the lower edge surface of the lid. This lid configuration is convenient for restricting the effect of melt splashes and for returning the splashed melt back to the ladle. The diameter of the cone opening facing towards the ladle will preferably be smaller than the diameter of the upper opening of said ladle. In the case of one practical lid configuration, the lower edge surface of the cone has extending circumferentially therearound a flange which forms a supporting and sealing surface against the upper edge surface of the ladle.

Other characteristic features of the invention will be apparent from the following claims.

The invention will now be described in more detail with reference to the accompanying drawings.

Figure 1:
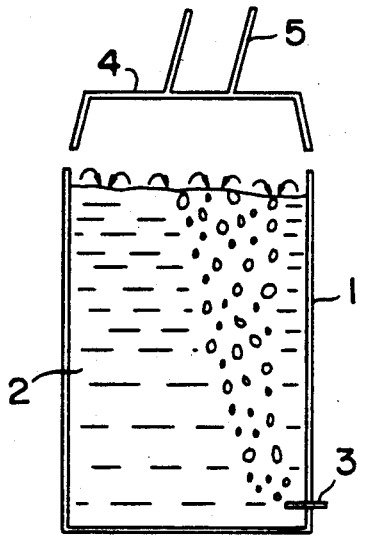
FIG. 1 illustrates schematically a ladle arrangement of known construction intended for ladle metallurgy.

FIG. 1 illustrates a conventional ladle 1, which is filled substantially to capacity with a metal melt 2. The reference numeral 3 designates a nozzle through which gas or a gas/powder mixture is introduced into the ladle for treating the melt 2, for instance purifying and/or alloying the melt. A hood 4, provided with a suction conduit 5, is mounted above the ladle 1 for the purpose of removing by suction gas and smoke rising from the melt.

It will be evident that the specific gas flow which can be used with this known ladle arrangement is highly restricted because of the absence of space for accommodating splashes from the melt and the absence of means for returning melt splashes to the melt contained by the ladle. If the specific gas flow to this ladle arrangement were to be increased, a large part of the melt would "boil over", therewith blocking the flue gas conduit and rendering further operation of the ladle impossible.

In the case of this known ladle arrangement, only a relatively small specific gas flow can be utilized, this gas flow being in the order of 0.002 $Nm^3$ /ton/min, min, as before mentioned. This limitation constitutes a serious drawback and restricts the utility of ladle metallurgy.

Figure 2:
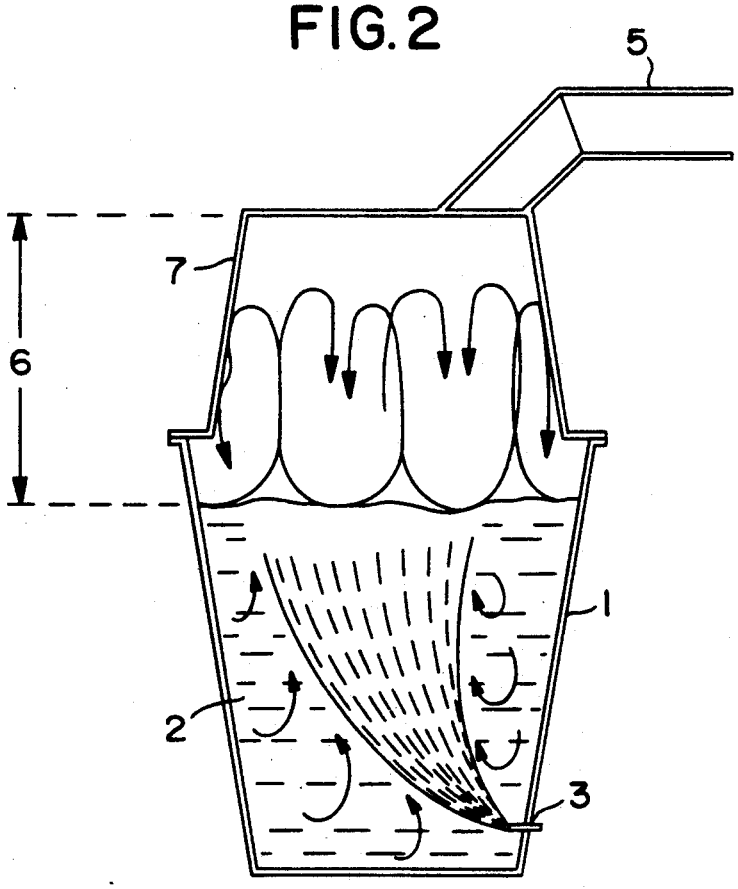
FIG. 2 illustrates schematically an inventive ladle arrangement.

FIG. 2 illustrates schematically an inventive ladle arrangement, with which a sealed splash space or chamber 6 is formed above the surface of the melt 2. This space is obtained by giving the suction hood the form of a lid 7 which seals against the ladle 1 and which is of such configuration as to define a large free volume between the melt and the lid. It is necessary for this volume to correspond to an essential part of the volume of melt in the ladle, at least ⅓ of the melt volume, and preferably between 0.5 and 1 times the melt volume. This will enable the nozzle 3 to be designed for a very high specific gas flow in the same order of magnitude as that used in the conventional treatment of melts in converters, i.e. 1–4 $Nm^3$ /ton/min.

The molten metal that bubbles and splashes vigorously from the ladle is therewith contained in the closed space, while retaining an effective gas-extracting effect through the lid. As will be seen from FIG. 2, the lid 7 sealingly abuts the ladle 1, so as not to form a gap through which molten metal is able to escape. This greater gas flow enables the gas to be introduced into the melt and to agitate said melt more effectively than was earlier the case.

The lid 7 will preferably have the shape of a frustrated cone. This shape affords successive limitation of the splash space in a lateral or radial direction and the lid may be given a vertical extension or height such as to prevent undesirable melt deposits forming on its top surface. By providing the frustoconical lid with a lower opening of smaller diameter than the upper opening of the ladle 1, the inner walls of the cone will form splash-metal paths which function to conduct splashed melt down into the melt in the ladle, without risk of the splashed melt running out onto the outer ladle surface. For practical reasons, the lower part of the lid will preferably be provided with a circumferential flange 8 which forms a combined support and sealing surface in coaction with the upper defining edge of the ladle 1. This provides a very simple and practical solution to the problem of providing a seal between lid and ladle and of returning upwardly splashing melt back to the ladle.

A lid 7 of specific configuration has been described above. This configuration, however, can be varied in several respects within the scope of the following claims while retaining the main lid function of defining a splash space of requisite size and of conducting melt splashes back to the ladle. Although not shown, at least the inner surfaces of the lid will have a heat-resistant construction and will preferably comprise a layer of refractory material, so as to withstand contact with the hot molten metal. .

I claim:

1. A method of treating molten metal in a ladle, in which a gas or gas/powder mixture is introduced to the melt in a substantially full ladle and in which departing gases are removed by suction through a hood mounted above the ladle, characterized by delivering a large volmetric flow of at least 1 $Nm^3$/ton/minute of gas or gas/powder mixture to the melt, resulting in highly vigorous bubbling and splashing of molten metal from the melt; restricting the effects of said bubbling and splashing melt to a defined space above the melt, wherein the gas extraction hood is in the form of a lid and essential seals against the upper edge of the ladle; and wherein the volume defined by the lid above the melt corresponds to at least half of the volume of melt in the ladle; by causing melt which has splashed up on the inside of the lid to return to the melt in the ladle along the sides of said lid.

2. A method according to claim 1, characterized by returning melt which splashes on the inside of the lid to the melt contained in the ladle by conducting said melt splashes along pathways on inner surfaces of the lid which terminate radially inwards of upper defining edge of the ladle.

3. The method according to claim 1 wherein said volumetric flow is 1–4 $Nm^3$/ton/minute.

4. A ladle arrangement intended for use when treating a metal melt, in which gas or gas/powder mixture is delivered to the melt which substantially fills the ladle completely and in which gas is extracted by suction through a hood means mounted above the ladle, characterized in that the configuration of the hood means is for permitting a large volumetric flow of at least 1 $Nm^3$/ton/minute of gas/powder to be delivered to the melt, and wherein the configuration of the hood is in the form of a lid for limiting effects of metal splashes to a defined space above the melt, and wherein said lid is substantially sealed against the upper edge of the ladle; and wherein the volume defined by said lid above the ladle corresponds to at least one half of the volume of the melt to be treated in the ladle, and wherein said lid includes inner side surfaces for defining conducting pathways for splash-metal droplets to be returned to the melt in the ladle along the inner side surfaces of the lid.

5. A ladle arrangement according to claim 4, characterized in that the ladle includes an upper defining edge and the inner side surfaces of the lid (7) for splash-metal pathways which terminate radially inwards of upper defining edge of the ladle (1).

6. A ladle arrangement according to claim 4, characterized in that at least the inner side surfaces of the lid (7) have a heat-resistant construction.

7. A ladle arrangement according to claim 5, characterized in that the lid (7) has a frustoconical configuration and a lower lid edge surface and is intended to support against the upper defining edge of the ladle (1) along said lower lid edge surface.

8. A ladle arrangement according to claim 5, characterized in that the diameter of the opening of the frustoconical configuration facing towards the ladle (1) is smaller than the diameter of the upper ladle opening.

9. A ladle arrangement according to claim 8, characterized in that the lower edge of the frustoconical configuration is configured with a circumferentially extending flange (8) which forms a support and sealing surface against the upper edge of the ladle (1).

10. A ladle arrangement according to claim 6 wherein said heat-resistant construction includes a layer of refractory material.

* * * * *